US009737918B2

(12) United States Patent
Jansen et al.

(10) Patent No.: US 9,737,918 B2
(45) Date of Patent: Aug. 22, 2017

(54) METHOD AND APPARATUS FOR CLEANING RAILROAD TANK CARS

(71) Applicant: BioChem Systems, Inc., Spring, TX (US)

(72) Inventors: Bruce Jansen, Montgomery, TX (US); Cody Nath, Houston, TX (US)

(73) Assignee: BioChem Systems, Inc., Spring, TX (US)

( * ) Notice: Subject to any disclaimer, the term of this patent is extended or adjusted under 35 U.S.C. 154(b) by 173 days.

(21) Appl. No.: 14/885,438

(22) Filed: Oct. 16, 2015

(65) Prior Publication Data

US 2016/0107205 A1 Apr. 21, 2016

Related U.S. Application Data

(60) Provisional application No. 62/065,442, filed on Oct. 17, 2014.

(51) Int. Cl.

| | |
|---|---|
| ***B08B 9/08*** | (2006.01) |
| ***B08B 9/28*** | (2006.01) |
| ***B08B 3/08*** | (2006.01) |
| ***B08B 3/14*** | (2006.01) |
| ***B08B 3/00*** | (2006.01) |
| ***B61D 5/00*** | (2006.01) |
| ***C11D 11/00*** | (2006.01) |
| ***C11D 3/37*** | (2006.01) |
| ***C11D 7/50*** | (2006.01) |
| *C11D 7/24* | (2006.01) |

(52) U.S. Cl.

CPC ..... *B08B 9/08* (2013.01); *B08B 3/00* (2013.01); *B08B 3/14* (2013.01); *B08B 9/283* (2013.01); *B61D 5/00* (2013.01); *C11D 3/3707* (2013.01); *C11D 7/5027* (2013.01); *C11D 11/0041* (2013.01); *C11D 7/24* (2013.01)

(58) Field of Classification Search

CPC .... B08B 3/00; B08B 3/04; B08B 3/08; B08B 9/00; B08B 9/08; B08B 9/0813; B08B 9/093; B08B 9/933; B08B 9/0936; B08B 9/283; C11D 3/3707; C11D 7/24; C11D 7/5027; C11D 11/0041; B61D 5/00

See application file for complete search history.

(56) References Cited

U.S. PATENT DOCUMENTS 3,025,190 A * 3/1962 Groom ..... B08B 9/08 134/10

3,833,010 A * 9/1974 McDermott ..... B08B 9/093 134/22.18

* cited by examiner

*Primary Examiner* — Saeed T Chaudhry

(74) *Attorney, Agent, or Firm* — Blank Rome, LLP

(57) ABSTRACT

A blend of aliphatic hydrocarbons and polyglycol ether(s) is used in a process for cleaning railroad tank cars that have been gravity drained of hydrocarbon fluids but may be left with a residuum containing heavy hydrocarbons, paraffin and noxious gas. A simple recirculation system is established between the chemical source, the contaminated railcar, canister filters and back to the chemical source. Contaminates are removed from the cleaning chemical by the filters and there is no water or steam used which might otherwise damage the railcar.

11 Claims, 1 Drawing Sheet

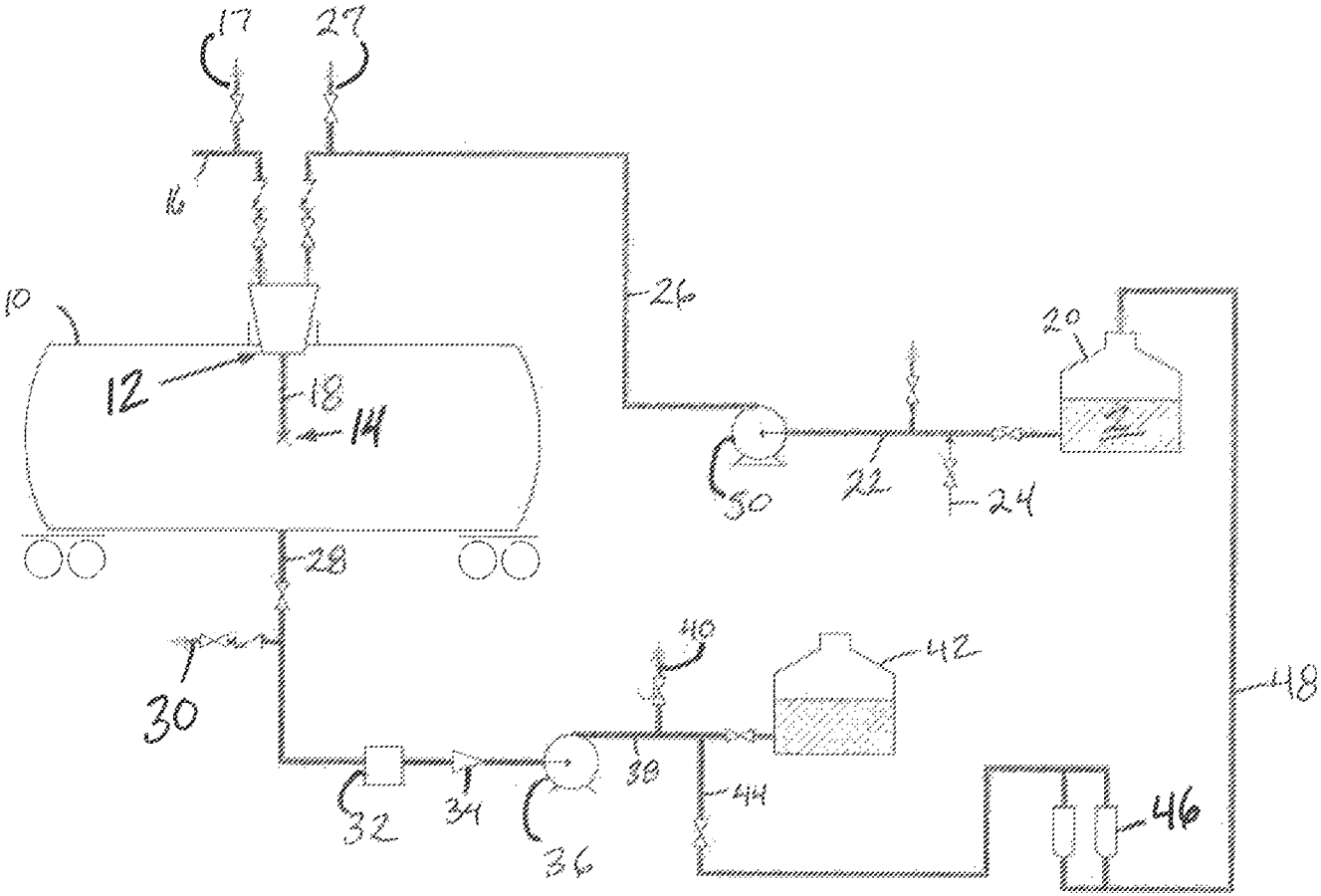
10
12
14
16
17
18
20
22
24
26
27
28
30
32
34
36
38
40
42
44
46
48
50

METHOD AND APPARATUS FOR CLEANING RAILROAD TANK CARS

CROSS-REFERENCE TO RELATED APPLICATIONS

This application claims the benefit of U.S. Provisional Application No. 62/065,442, filed on Oct. 17, 2014.

STATEMENT REGARDING FEDERALLY SPONSORED RESEARCH OR DEVELOPMENT

Not Applicable

BACKGROUND OF THE INVENTION

1. Field of the Invention

The present invention generally relates to industrial cleaning processes and devices. More particularly, it relates to a method and apparatus for cleaning petroleum residuum from tanks such as railroad tank cars.

2. Description of the Related Art Including Information Disclosed Under 37 CFR 1.97 and 1.98

In the past, rail tank cars have been cleaned using large and complex equipment requiring multiple operators and an assortment of chemicals, typically water based. In addition to these methods, it is common to place personnel inside the tank cars to perform a final hydroblasting/cleaning step prior to inspection. These methods require several dispensing tanks, pumps, valves, filters, exchangers, air scrubbers and distribution equipment. Confined space entry of personnel also requires the use of a self-contained breathing apparatus (SCBA) or 'fresh air' during the entire entry period since the environment inside the tank can be immediately dangerous to life and health (IDLH).

Most of the cleaning systems of the prior art are immobile, expensive and the process is time consuming. They also generate large amounts of water and hydrocarbon effluent requiring special treatment and disposal methods. In addition, legacy processes require water rinsing which contributes to the effluent volume and creates flash rusting inside the tank.

BRIEF SUMMARY OF THE INVENTION

A process according to the present invention solves problems inherent in the prior art processes by using readily available equipment and a novel, effective, organic cleaning chemistry. The following benefits obtain:

a) elimination of a water rinse;

b) production of an effluent that can be sold for fuel blending (high BTU value);

c) cleaning of a rail tank car in less than thirty (30) minutes;

d) no requirement for any personnel to enter the tank thus eliminating the need for "fresh air";

e) utilization of a solvent blend that can be readily filtered, thereby extending the useful life of the solvent;

f) utilization of the solvent at ambient temperature; and, g) utilization of a solvent that comprises a highly refined aliphatic compound and a polyglycol ether that has high dielectric strength and is effective at cleaning tank internals which may include electrical switches.

The cleaning equipment is inexpensive in comparison to the systems of the prior art and is mobile, so that it can be moved to a railcar site rather than requiring moving the railcar to a cleaning site. The chemistry may be a blend of aliphatic hydrocarbons and polyglycol ethers. A simple recirculation system may be established between the chemical source, the contaminated tank (or railcar), canister filters and back to the chemical source. Contaminates may be removed from the cleaning chemical by the filters and there is no need for water or steam to be used which might otherwise damage the railcar.

The process may typically be accomplished by one worker in a period of 15 to 30 minutes without entering a railcar tank.

The chemistry may be pumped via a multi-directional spray nozzle into the contaminated railcar, circulated through canister filters which remove particulates and heavy oils, and returned to the chemical container for re-use.

BRIEF DESCRIPTION OF THE SEVERAL VIEWS OF THE DRAWING(S)

FIG. 1 is a schematic diagram of one embodiment of the invention.

DETAILED DESCRIPTION OF THE INVENTION

In one particular preferred embodiment, an appropriate amount (typically 275 or 550 gallons) of cleaning chemical is blended and filled into a standard 275 or 550 gallon tote. One particular preferred cleaning chemical is a blend of aliphatic hydrocarbons comprising C6-C18 molecules and polyglycol monomethyl ether. One particular, preferred formulation may be 40-80% aliphatic hydrocarbon and 20-60% polyglycol monomethyl ether. However, the blend may vary depending on the Kauri-butanol value of the individual ingredients. The Kauri-butanol value ("Kb value") is an international, standardized measure of solvent power for a hydrocarbon solvent, and is governed by an ASTM standardized test, ASTM D1133. The result of this test is a scaleless index, usually referred to as the "Kb value". A preferred target Kb value is 106. To achieve the target Kb value, the blend may range from 20% to 80% polyglycol ethers in aliphatic hydrocarbon(s).

Recirculation and distribution equipment may be brought to the railcar including:

1. Pumps (typically two) capable of providing about 125 psig for supplying chemistry to the railcar spray nozzle and removing effluent from the railcar, pushing it through the filter system;

2. Totes (typically 2) to bring solvent to the railcar and collect effluent from the railcar;

3. A filter system to collect particulates and otherwise insoluble hydrocarbons;

4. A distribution nozzle for applying the chemical inside the railcar. This can be any of a variety of rotary spray nozzles available to the industry—e.g. a "Butterworth® nozzle" (Butterworth Technology, Inc. 16737 W. Hardy Street Houston Tex. 77060); and, 5. An assortment of basic, moderate-pressure, chemical hoses and valves for the interconnections.

The totes and equipment may be set up in a manner similar to the one shown schematically in FIG. 1 wherein solvent 2 is contained within tank or tote 20. Tank 20 is in fluid communication with pump 50 via line 22 which may include valve 1 and valved purge line 24. In the illustrated embodiment, pump 50 is a positive-displacement pump. Other suitable types of pumps may be used.

Discharge line 26 from pump 50 may include valved vent line 27 and is in fluid communication with spray nozzle 14 via valve/check valve combination 3 and spray arm 18 mounted on spray nozzle manway assembly 12. In the illustrated embodiment, spray nozzle manway assembly 12 is adapted for connection to rail tank car 10.

Drain line 28 is also removably attached to the tank of railcar 10 preferably at or near the low point of the tank. Drain line 28 is in fluid communication with effluent recovery pump 36 via valve 4, knockout pot 32 (for the removal of heavy solids), and strainer 34. Sample point 30 may be provided in drain line 28 with valve/check valve combination 7 to obtain samples of the recirculating solvent for testing. In the illustrated embodiment, effluent recovery pump 36 is a diaphragm pump. Other suitable types of pumps may be used.

Discharge line 38 from pump 36 may be in fluid communication with effluent recovery tank or tote 42 (via open valve 5) or, alternatively, in fluid communication with filter assembly 46 via line 44 (and open valve 9). Discharge line 38 may be provided with vent 40 comprising valve 6.

Filter assembly 46 may comprise one or more suitable filter units. In the illustrated embodiment, filter assembly 46 comprises two filter units plumbed in parallel. One particular preferred filter unit is a cotton-wound canister filter. Filtered solvent is returned to solvent tank or tote 20 via return line 48.

The illustrated embodiment additionally includes optional means for purging and/or drying the interior of tank car 10 following the solvent wash. Compressed air (or other suitable gas such as nitrogen) may be introduced into tank 10 via line 16 (which may include valved vent 17) and valve/check valve combination 8. The terminus of line 16 may be mounted within manway assembly 12. Exhaust may be via sample point 30 with valves 4 and 7 open. Alternatively and/or additionally, exhaust means may be provided in manway assembly 12.

An exemplary process according to the invention may be practiced as described below (with reference to FIG. 1):

1. Check effluent pump strainer 34 to ensure it is clean. Check that the railcar vent is clear and make certain that railcar drain valve 4 is clear. Inspect railcar through the top manway; check for free oil and/or paraffin plugging the effluent drain valve 4 in bottom of railcar 10. Free liquid may be transferred to oil tote 42 and paraffin needs to be removed from the entrance to drain line 28. These activities may be performed from the top railcar manway without personnel entering the railcar.

2. Ensure that railcar 10 and all associated equipment and chemical totes are properly grounded and bonded as necessary to prevent static charge build-up.

3. Install manway spray nozzle assembly 12 in railcar manway and secure.

4. Open valves 1, 3, 4, and 5;

5. Pump out any free liquid from railcar 10 into effluent recovery tote 42.

6. When effluent pump 36 cavitates, close valve 5 and open valve 9.

7. Start chemical injection pump 50.

8. Monitor effluent turbidity by periodic sampling at sample point 30 by opening valve 7.

9. Circulate cleaning solvent 2 for about 15-30 minutes or until turbidity/appearance stabilizes, then shut down chemical injection pump 50 and close valves 1 and 3. Continue pumping out effluent from railcar 10 until pump 36 begins to cavitate.

10. Open valve 8 (air supply) and purge any remaining effluent from railcar 10, if necessary.

11. When no effluent appears at sample point 30 when valve 7 is opened, shutdown effluent pump 36 and close valve 8.

12. Dry out railcar with air (valve 8 open) and open valve 7 for air exhaust.

13. When the interior of railcar 10 is sufficiently dry, shutdown compressed air and close valves 7 and 8.

14. Remove railcar manway sprayer assembly 12 and notify an inspector that railcar 10 is ready for inspection.

Contaminants trapped in filter(s) 16 may be disposed of together with the filter media. The Kb value of the filtered cleaning chemical may be verified and the solvent may be reused until such time that the Kb value drops below a preselected value—e.g., 60. At that point, the spent chemical 2 may be sold to a fuel blender for its BTU value (or otherwise disposed of).

The foregoing presents particular embodiments of a system embodying the principles of the invention. Those skilled in the art will be able to devise alternatives and variations which, even if not explicitly disclosed herein, embody those principles and are thus within the invention's spirit and scope. Although particular embodiments of the present invention have been shown and described, they are not intended to limit what this patent covers. One skilled in the art will understand that various changes and modifications may be made without departing from the scope of the present invention as literally and equivalently covered by the following claims.

What is claimed is:

1. A method for cleaning a tank comprising:

circulating an blend of aliphatic hydrocarbons and polyglycol ether(s) through the interior of the tank and into a filter;

monitoring a turbidity of the circulating blend; and, discharging the circulating blend from the tank when the turbidity reaches a preselected value.

2. The method recited in claim 1 further comprising:

drying the interior of the tank.

3. The method recited in claim 2 wherein drying the interior of the tank comprises introducing air into the tank or allowing natural air drying to occur.

4. The method recited in claim 3 wherein the air is compressed air supplied via a removable manway assembly installed on the tank.

5. The method recited in claim 1 wherein the blend of aliphatic hydrocarbons and polyglycol ether(s) comprises polyglycol monomethyl ether.

6. The method recited in claim 1 wherein the blend of aliphatic hydrocarbons and polyglycol ether(s) comprises C6-C18 aliphatic hydrocarbon molecules.

7. The method recited in claim 1 wherein the blend of aliphatic hydrocarbons and polyglycol ether(s) consists essentially of C6-C18 aliphatic hydrocarbon molecules and polyglycol monomethyl ether.

8. The method recited in claim 7 wherein the blend of aliphatic hydrocarbons and polyglycol ether(s) consists essentially of about 40% to about 80% by volume C6-C18 aliphatic hydrocarbons with a balance being polyglycol monomethyl ether.

9. The method recited in claim 8 wherein the blend of aliphatic hydrocarbons and polyglycol monomethyl ether is selected to provide a Kauri-butanol value ("Kb value") of about 106 per a test procedure of standardized test ASTM D1133.

10. The method recited in claim 1 wherein circulating a blend of aliphatic hydrocarbons and polyglycol ether(s)

through the interior of the tank comprises applying the blend to the interior of the tank using a spray nozzle.

11. The method recited in claim 1 further comprising: recirculating effluent from the filter to the tank.

* * * * *